US009278274B2

(12) United States Patent
O'Donoghue

(10) Patent No.: US 9,278,274 B2
(45) Date of Patent: Mar. 8, 2016

(54) MOUTH GUARD

(71) Applicant: James M. O'Donoghue, Mundelein, IL (US)

(72) Inventor: James M. O'Donoghue, Mundelein, IL (US)

( * ) Notice: Subject to any disclaimer, the term of this patent is extended or adjusted under 35 U.S.C. 154(b) by 154 days.

(21) Appl. No.: 13/835,778

(22) Filed: Mar. 15, 2013

(65) Prior Publication Data

US 2014/0261461 A1 Sep. 18, 2014

(51) Int. Cl.

| | |
|---|---|
| ***A61C 5/14*** | (2006.01) |
| ***A63B 71/08*** | (2006.01) |
| *A63B 71/00* | (2006.01) |

(52) U.S. Cl.

CPC ..... *A63B 71/085* (2013.01); *A63B 71/0036* (2013.01)

(58) Field of Classification Search

CPC ..... A61F 5/566; A61F 5/56; A61B 17/0401; A61B 17/24; A61B 2017/0412; A61B 2017/042; A61B 2017/0422; A61B 2017/0427; A61B 2017/0433; A61B 2017/0435; A61B 2017/0437; A61B 2017/0438

USPC ..... 128/848, 859–862; 602/902

See application file for complete search history.

(56) References Cited

U.S. PATENT DOCUMENTS

| | | | | |
|---|---|---|---|---|
| 4,791,941 | A | 12/1988 | Schaefer | |
| 7,305,990 | B2 | 12/2007 | Mathias | |
| 7,353,828 | B1 | 4/2008 | Hirshberg | |
| 7,530,355 | B2 | 5/2009 | Berghash | |
| 7,607,438 | B2 | 10/2009 | Pelerin | |
| 7,819,122 | B2 | 10/2010 | Abramson | |
| 7,882,839 | B2 | 2/2011 | Ambis, Jr. | |
| 7,913,695 | B1 | 3/2011 | Moore et al. | |
| 8,033,392 | B1 | 10/2011 | Gehner et al. | |
| 8,091,555 | B2 | 1/2012 | Morgan et al. | |
| 8,186,356 | B2 | 5/2012 | Pelerin | |
| 8,235,052 | B2 | 8/2012 | Maurello | |
| 2006/0207610 | A1 * | 9/2006 | Anonsen | 128/859 |
| 2011/0155146 | A1 | 6/2011 | Marsh | |
| 2012/0174932 | A1 | 7/2012 | Wilson | |
| 2014/0174456 | A1 * | 6/2014 | Bentley, Jr. | 128/861 |

* cited by examiner

*Primary Examiner* — Michael Brown

(74) *Attorney, Agent, or Firm* — Michael A. Hierl; Hughes Socol Piers Resnick & Dym, Ltd.

(57) ABSTRACT

An improved mouth guard for use in contact sports comprises a substantially curved portion for protecting the teeth of a user, the curved portion including an inner wall and an outer wall, the inner wall including a palate member extending therefrom defining a cutaway portion adapted to engage a structural member of a face mask, face shield or article of clothing for convenient storage.

15 Claims, 3 Drawing Sheets

MOUTH GUARD

FIELD OF THE INVENTION

The present invention relates in general to a mouth guard and, in particular, to an athletic mouth guard for protecting the teeth of a user engaged in a contact sport, the device being adapted for convenient storage when not in use.

BACKGROUND OF THE INVENTION

A conventional mouth guard is a flexible device with a u-shaped channel worn over the teeth during athletic or recreational activities. Mouth guards protect the teeth from chipping or displacement and minimize the risk of soft tissue damage to the cheek, lips and tongue. Mouth guards are commonly used, and often required, in contact sports including football, lacrosse and hockey to protect the teeth of an athlete. The use of mouth guards in other sports including basketball, soccer, boxing and wrestling is also recommended.

Mouth guards also help to avoid displacement of the lower jaw into the upper jaw which could lead to jaw fracture, concussion and neck injuries. In short, a mouth guard should be used whenever contact with hard surfaces or other players is possible.

In preferred practice, a mouth guard should be easy to insert into the mouth and should remain firmly in place during use. A mouth guard should also fit comfortably and not restrict breathing. It is also desirable for the device to be durable and easy to clean. Moreover, the device should be tear-resistant, odorless and tasteless.

Stock or ready-made mouth guards are manufactured in pre-formed shapes in various sizes. Depending on the user, such mouth guards usually do not fit particularly well. As an alternative, mouth guards can be made of a flexible, resilient thermoplastic material in various shapes and sizes which can be adapted by heating and molding to more closely conform to the shape of the user's mouth. Use of the latter type of mouth guard is usually preferred.

In addition, many contact sports require the athlete to wear a helmet or other protective head gear which can include a face mask or face shield. When the athlete is not playing, it is desirable to be able to remove the mouth guard and store the device for easy access. The mouth guards frequently used by football players, for example, include a strap or tether that connects the mouth guard to the face mask of a helmet. But some players find the loosely hanging mouth guard annoying with head movement between plays. It would be beneficial to develop a mouth guard that can be directly, but removably, secured to a face mask, face shield or other support member and eliminate the use of the strap or tether thereby keeping the device accessible and clean when not in use.

SUMMARY OF THE INVENTION

A mouth guard according to the present invention is formed of a flexible, resilient material and comprises a substantially curved portion for protecting the teeth of a user while engaged in a contact sport. The curved portion includes an inner wall and an outer wall, the inner wall including a palate member extending therefrom defining a cutaway portion adapted to engage a structural member of a face mask or face shield, for example, when the mouth guard is not being used. A lower portion between the inner wall and the outer wall defines a channel for receiving and positioning the teeth of the user.

In a preferred embodiment, the cutaway portion includes a generally circumferential edge that firmly, but removably or releasably, engages the surface of the structural member. The circumferential edge of the cutaway portion can include a raised or thickened portion to enhance the durability of the device and minimize tearing of the palate member during use.

If desired, the palate member can be inclined in an upward plane from a proximal end along the inner wall to a distal end positioned during use towards the mouth of the user to minimize contact between the palate member and the tongue of the user. The palate member can also be molded to generally conform to the shape of the palate of the user.

The present mouth guard has a number of advantages over conventional mouth guards including easy access during use and convenient storage. Storing the mouth guard upon attachment to a structural member, such as a face mask or face shield, reduces contact of the device with dust and dirt.

BRIEF DESCRIPTION OF THE DRAWINGS

In the drawings, which comprise a portion of the present disclosure.

DETAILED DESCRIPTION OF THE INVENTION

Figure 1:
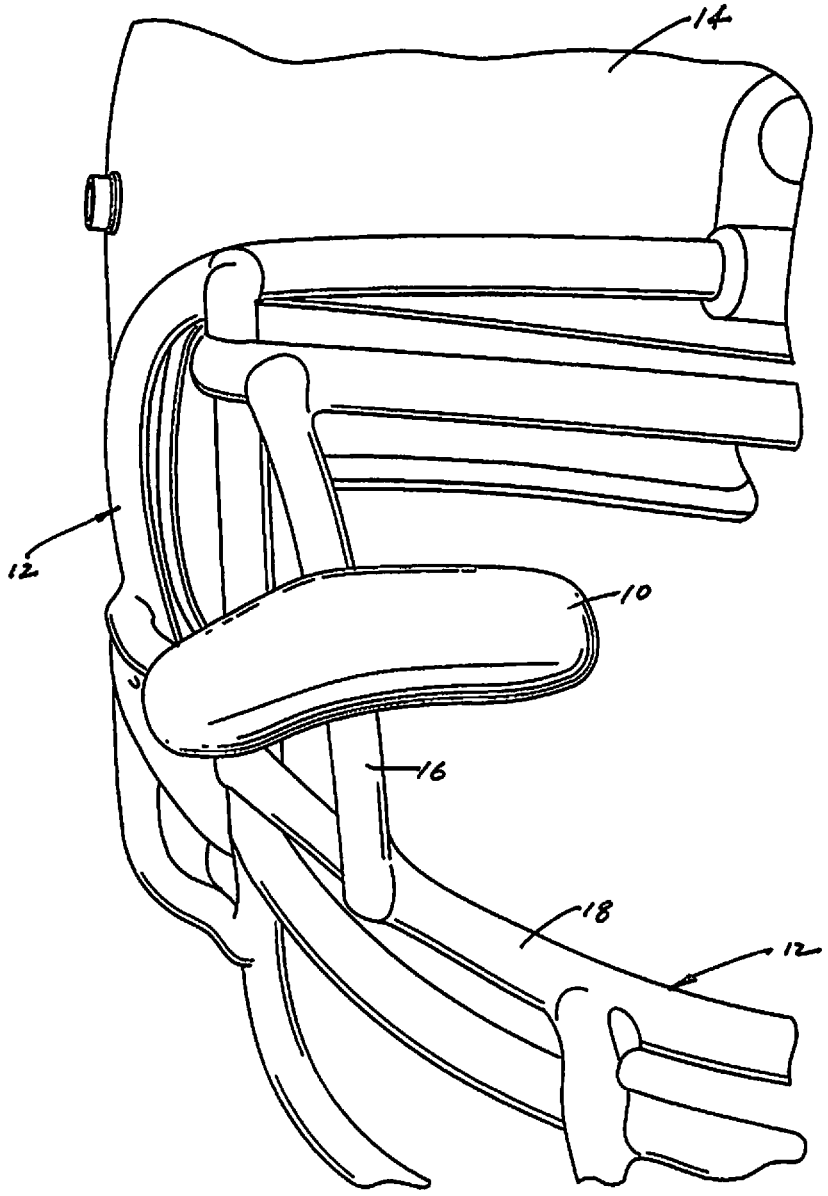
FIG. 1 is a partial perspective view of an embodiment of a mouth guard according to the present invention removably secured to a post of a face mask mounted to the front of a football helmet.

As shown in FIG. 1, the present invention relates to an improved athletic mouth guard 10 adapted for use in conjunction with a face mask 12, for example, of a helmet 14 or other protective head gear for use in contact sports. As described herein, the mouth guard can also be adapted for use with a face shield of a hockey helmet or the brim of a baseball cap or batting helmet. In another embodiment, the mouth guard can be adapted for connection to an article of clothing including a jersey, shirt or pants. The mouth guard 10 is preferably molded of a flexible, resilient material, as known in the art. When not in use, the mouth guard 10 can be removably or releasably secured to a post 16 or other support member of the face mask 12, for example, for convenient storage and to maintain the mouth guard in a sanitary condition. If desired, the mouth guard can be removably secured to a horizontal bar 18 of the face mask.

In the illustrated embodiment, the mouth guard 10 comprises a substantially curved portion 20 for protecting the teeth of a user, the curved portion 20 including an inner wall 22 and an outer wall 24, the inner wall 22 defining a cutaway portion 26 adapted to engage the post 16 or other structural portion of the face mask 12 when the mouth guard is not being used.

In particular, the present invention relates to an athletic mouth guard, preferably for protecting the teeth and facial soft tissue of a user engaged in a contact sport, comprising a substantially curved portion including an inner wall having a lower end 28, an outer wall having a lower end 30 and a lower transverse connecting portion 32 between the lower ends to define a channel 34 for receiving and positioning the teeth of the user. Extending from the inner wall towards the tongue of the user is a generally flat palate member 36 that defines the cutaway portion 26 adapted to removably engage the post 16 or other support member of the face mask 12 when the mouth guard is not being used. The cutaway portion 26 defines an opening 38 for receiving the post or other support member of the face mask so that the post or other support member is substantially and firmly engaged about its circumference by the edges 40 of the cutaway portion.

The mouth guard 10 preferably only covers the upper teeth, but can be made to cover both the upper and lower teeth, which is particularly desirable if the user wears braces or other dental appliances including a retainer.

In a preferred embodiment, the edges 40 of the cutaway portion 26 are raised, reinforced or thickened to enhance the durability of the device and to minimize tearing of the palate member 36 along the edges of the cutaway portion during use. In a further preferred embodiment, the palate member 36 is inclined somewhat in an upward plane away from the channel 34 from a proximal end 42 along the inner wall 22 to a distal end 44 positioned during use towards the mouth of the user to minimize contact between the distal end of the palate member and the tongue of the user. Moreover, the palate member 36 can include a curvature that generally corresponds to the arcuate contour of the palate of the user.

Figure 2:
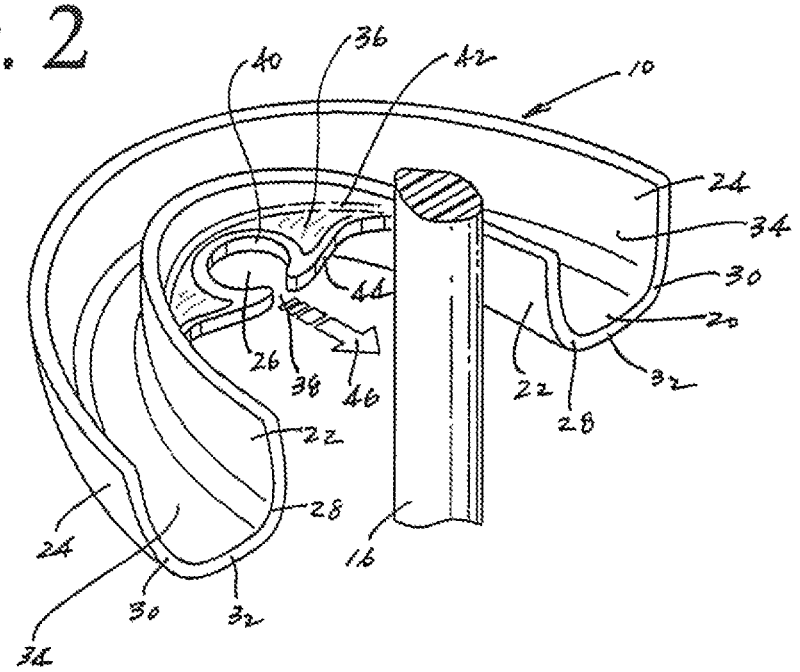
FIG. 2 is a perspective view of the mouth guard of FIG. 1 in a position for attachment to a face mask.
Figure 3:
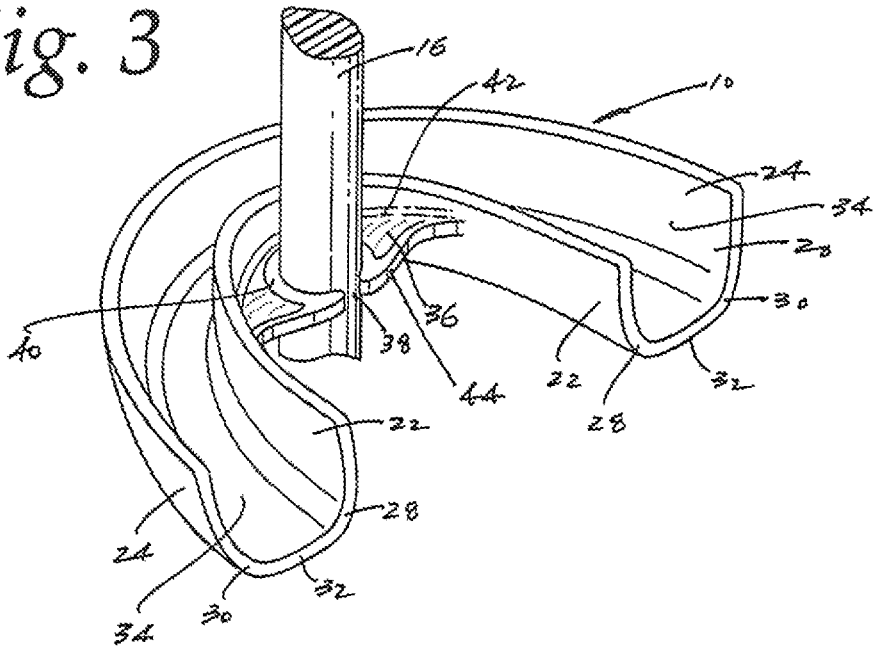
FIG. 3 is a perspective view of the mouth guard of FIG. 2 removably secured to the post of the face mask.

FIG. 2 shows the mouth guard 10 in position for connection to the post 16 of a face mask 12. The mouth guard is moved in the direction of the arrow 46 whereby the edges 40 of the cutaway portion 26 engage and wrap around the post 16 to hold the mouth guard in a secure, but removable, position. See FIG. 3 which shows the engagement of the mouth guard 10 to the post 16 or other support member.

Figure 4:
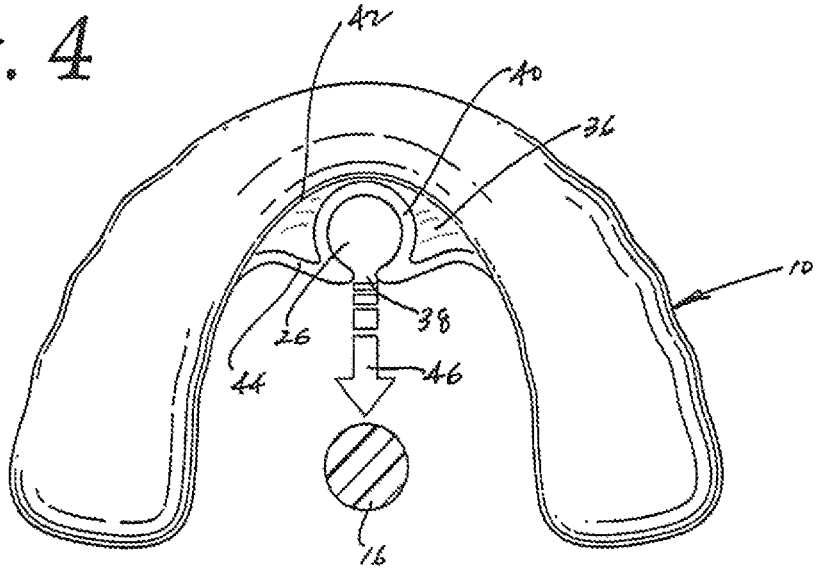
FIG. 4 is a bottom view of the mouth guard of FIG. 1 in a position for attachment to a face mask.
Figure 5:
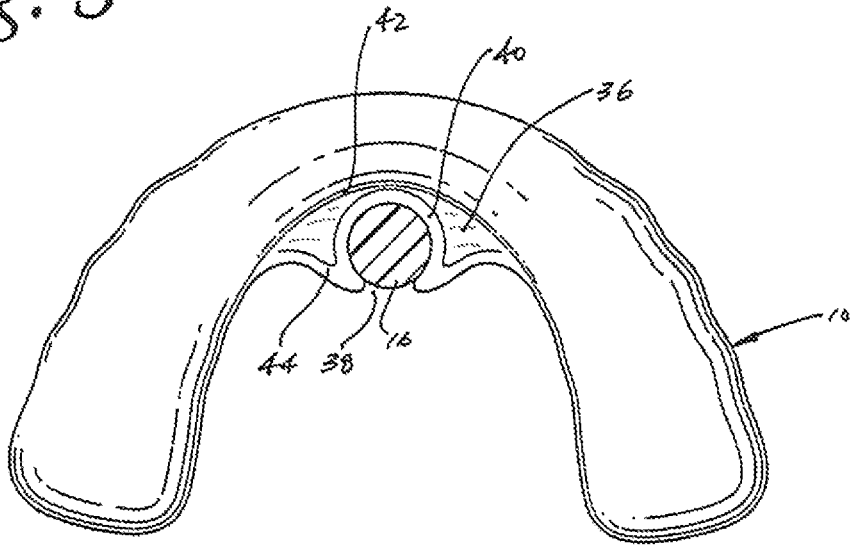
FIG. 5 is a bottom view of the mouth guard of FIG. 4 removably secured to the post of the face mask.

FIG. 4 is a bottom view of the mouth guard 10 and provides a further illustration of how the edges 40 of the cutaway portion 26 firmly engage the post 16. FIG. 5 further shows the engagement of the edges 40 of the cutaway portion 26 relative to the post 16. The resilient nature of the palate member 36 and the edges 40 of the cutaway portion 26 provide for an effective connection to the post 16.

The drawings show the cutaway portion 26 generally formed in the shape of a ring to engage and wrap around the post 16 of a face mask 12. In an alternative embodiment, the cutaway portion 26 can be formed in the shape of a slot (not shown) for removable/releasable attachment, for example, to a face shield of a hockey helmet or to a brim of a baseball cap or batting helmet. The cutaway portion 26 should be configured to removably engage a surface of the relevant structural member, whether the structural member is the post of a face mask, the edge of the face shield of a hockey helmet, or the brim of a baseball cap or batting helmet.

In a further embodiment (not shown), a structural member in the form of a cylinder, tube or ring, for example, is secured to a jersey, shirt, pants or other article of athletic clothing to provide a point of attachment for the mouth guard of the present invention. In particular, a structural member can be sewn onto an article of athletic clothing or into a hem portion, for example, to provide the equivalent of a post for removably securing the mouth guard to the article of clothing via the cutaway portion for convenient storage when the mouth guard is not being used. This embodiment could be used by any athlete in any sport. However, it is particularly useful in contact sports including basketball, soccer and boxing that do not involve use of a face mask or face shield, but where it would be advantageous to provide means for removably attaching a mouth guard.

The ability of the present device to removably/releasably mount the mouth guard directly to the structural member avoids the disadvantages associated with a conventional tethered mouth guard and provides a protective device that is simple to use, hygienic and effective in protecting the teeth of the user.

Numerous structural and functional modifications and adaptions may be achieved, as those of ordinary skill in the art will readily appreciate, without departing from the spirit and scope of the invention.

What is claimed is:

1. A mouth guard comprising a substantially curved portion for protecting the teeth of a user, the curved portion including an inner wall and an outer wall, the inner wall including a palate member extending therefrom defining a cutaway portion adapted to engage a structural member when the mouth guard is not being used; and said cutaway portion including a generally circumferential edge that engages the structural member about its circumference, with said circumferential edge of the cutaway portion including a thickened portion to enhance the durability of the device and minimize tearing of the palate member during use.

2. The mouth guard according to claim 1 wherein the structural member comprises a face mask.

3. The mouth guard according to claim 1 wherein the structural member comprises a face shield.

4. The mouth guard according to claim 1 wherein the structural member is secured to an article of clothing.

5. The mouth guard according to claim 1 including a lower portion between the inner wall and the outer wall to define a channel for positioning the teeth of the user.

6. A mouth guard comprising a substantially curved portion for protecting the teeth of a user, the curved portion including an inner wall and an outer wall, the inner wall including a palate member extending therefrom defining a cutaway portion adapted to engage a structural member when the mouth guard is not being used; and said palate member inclined in an upward plane from a proximal end along the inner wall to a distal end positioned during use towards the mouth of the user to minimize contact between the palate member and the tongue of the user.

7. The mouth guard according to claim 6 wherein the palate member generally corresponds to the shape of the palate of the user.

8. The mouth guard according to claim 6 formed of a resilient material.

9. An athletic mouth guard for protecting the teeth of a user engaged in a contact sport comprising:

a) a substantially curved portion including an inner wall, an outer wall and a lower connecting portion there between to define a channel for positioning the teeth of the user;

b) a palate member extending from the inner wall defining a cutaway portion adapted to removably engage a structural member of a face mask when the mouth guard is not being used; and the cutaway portion including an edge that engages a surface of the structural member, with the edge of the cutaway portion including a thickened portion to enhance the durability of the device and minimize tearing of the palate member during use.

10. An athletic mouth guard for protecting the teeth of a user engaged in a contact sport comprising:

a) a substantially curved portion including an inner wall, an outer wall and a lower connecting portion there between to define a channel for positioning the teeth of the user;

b) a palate member extending from the inner wall defining a cutaway portion adapted to removably engage a structural member of a face mask when the mouth guard is not being used; and the palate member inclined in an upward plane from a proximal end along the inner wall to a distal end positioned during use towards the mouth of the user to minimize contact between the palate member and the tongue of the user.

11. The mouth guard according to claim 10 wherein the palate member generally conforms to the shape of the palate of the user.

12. The mouth guard according to claim 10 formed of a resilient material.

13. An athletic mouth guard for protecting the teeth of a user engaged in a contact sport comprising:

a) a substantially curved portion including an inner wall, an outer wall and a lower connecting portion there between to define a channel for positioning the teeth of the user;

b) a palate member extending from the inner wall defining a cutaway portion adapted to removably engage a structural member of a face mask when the mouth guard is not being used, the cutaway portion including a generally circumferential edge that engages the structural member about its circumference; and the circumferential edge of the cutaway portion including a thickened portion to enhance the durability of the device and minimize tearing of the palate member during use.

14. An athletic mouth guard for protecting the teeth of a user engaged in a contact sport comprising:

a) a substantially curved portion including an inner wall, an outer wall and a lower connecting portion there between to define a channel for positioning the teeth of the user;

b) a palate member extending from the inner wall defining a cutaway portion adapted to removably engage a structural member of a face mask when the mouth guard is not being used, the cutaway portion including a generally circumferential edge that engages the structural member about its circumference; and the palate member inclined in an upward plane from a proximal end along the inner wall to a distal end positioned during use towards the mouth of the user to minimize contact between the palate member and the tongue of the user.

15. The mouth guard according to claim 14 wherein the palate member generally corresponds to the shape of the palate of the user.

* * * * *